US007360329B2

(12) United States Patent
Bourgoin et al.

(10) Patent No.: US 7,360,329 B2
(45) Date of Patent: Apr. 22, 2008

(54) COMPOSITE FILE FOLDER

(75) Inventors: Arman Gilbert Bourgoin, Whitby (CA); Tyrone Michael Chin, Thornhill (CA); Ross Murray Nepean, Richmond Hill (CA)

(73) Assignee: Tab Products of Canada Ltd., Willowdale, ON (CA)

( * ) Notice: Subject to any disclaimer, the term of this patent is extended or adjusted under 35 U.S.C. 154(b) by 0 days.

(21) Appl. No.: 10/771,441

(22) Filed: Feb. 5, 2004

(65) Prior Publication Data

US 2005/0172529 A1 Aug. 11, 2005

(30) Foreign Application Priority Data

Mar. 12, 2003 (CA) ..... 2421694

(51) Int. Cl.
*B42F 21/00* (2006.01)
*B65D 27/00* (2006.01)

(52) U.S. Cl. ..... 40/359; 40/360; 283/36

(58) Field of Classification Search ..... 40/359, 40/360, 641; 281/29, 38, 45, 51; 283/36, 283/37, 39

See application file for complete search history.

(56) References Cited

U.S. PATENT DOCUMENTS 4,427,737 A * 1/1984 Cilento et al. ..... 428/315.7
4,806,397 A * 2/1989 Horwitz ..... 428/14
4,813,711 A * 3/1989 Bohlman ..... 283/81
5,090,732 A * 2/1992 Kuhns et al. ..... 281/29
5,197,764 A * 3/1993 Hicinbothem et al. ..... 283/81
5,275,439 A * 1/1994 Hawes et al. ..... 281/45
6,537,407 B1 * 3/2003 Law et al. ..... 156/209

FOREIGN PATENT DOCUMENTS

| | | |
|---|---|---|
| CA | 1 197 155 | 11/1985 |
| FR | 2 740 071 | 4/1997 |
| GB | 2 344 313 | 6/2000 |

* cited by examiner

*Primary Examiner*—Joanne Silbermann

(57) ABSTRACT

The reinforced file folder has a paper substrate which is reinforced with a breathable film having desirable properties with respect to wear. Preferably, the film is a cellulous based material adhered to the paper substrate in a manner that renders the product easily recycled. The cellulose film with a matte finished upper surface provides strong adhesion with file folder labels. The film preferably covers most of the outer surface of the front and back panels with the film applied either side of the labeling tab.

17 Claims, 4 Drawing Sheets

COMPOSITE FILE FOLDER

FIELD OF THE INVENTION

The present invention relates to reinforced file folders and in particular, relates to reinforced file folders having improved durability and improved characteristics with respect to writing thereon.

BACKGROUND OF THE INVENTION

It remains essential, in many industries to have an effective manual filing system for maintaining of records. These filing systems are based on file folders where each file folder is specific to a particular client or subject. The file folders have labeling tabs to which subject or client specific labels are secured. The file folders can include traditional top labeling tabs or lateral tabs for side tab filing.

Canadian Patent 1,197,155 discloses a reinforced file folder where the labeling tab of the file folder has been reinforced with a mylar reinforcing film. This reinforcing film is applied along one edge of the folder length and the edge of the folder is then folded upon itself and adhered. The folder edge is then die cut to form the labeling tab. This labeling tab has a reinforcing film on the exterior thereof and the film provides a smooth surface for receiving pressure sensitive labels. The reinforcing film has a polyethylene outer surface and an underlying thermally activated polypropylene layer. The file folder according to this prior patent has proven particularly successful in reinforcing the file folder adjacent the labeling tab such that the tab is not particularly prone to damage. Multi layer pressure sensitive labels having a similar polyethylene outer layer are commonly used to improve the appearance and durability of the labels.

In many industries such as the medical industry or the insurance industry, the front and/or back surfaces of the file folder are used to provide handwritten summary type information or a log of how the file has been used or reviewed. The front of the file can be used for signatures of the various people who have withdrawn the file at a particular point in time or can include more detailed client information which can be recorded on the file folder. To assist in providing an orderly recording of information, it has been known to print various panels of the file folder with category type information to provide a structure or template for the entering of information.

For some industries, it is desirable to reuse file folders and it is also known to provide a full plastic or plastic composite file folder for repeated use. Plastic file folders have increased durability, however, the cost is significantly higher and the file folders have some undesirable characteristics. Full plastic file folders do not stack as well as paper file folders. The cost of plastic file folders is also considerably higher and these folders have not been readily accepted in the marketplace. It would be desirable to provide a file folder which has improved characteristics with respect to repeated use while maintaining the desirable characteristics of traditional paper stock file folders.

Furthermore, recycling of reinforced file folders is difficult due to the polyethylene and polypropylene layers of the reinforcing film. In some applications, the widely diverging properties of the file folder paper stock and the plastic reinforcing film can cause manufacturing or application difficulties. It is important not to use a release agent, such as silicone, on the upper polyethylene layer. Such a release layer creates problems with respect to label adhesion.

SUMMARY OF THE INVENTION

A composite file folder according to the present invention comprises a front panel, a back panel and a labeling tab along one edge of the back panel with the back and front panels being integrally joined along one edge with a fold axis between the panels. The folder has a paper substrate support layer with a reinforcing film adhered to the exterior surfaces of the front and back panels across the fold axis and applied either side of the labeling tab. The reinforcing film is a multi layer film having a matte finish outer surface and an underlying adhesive inner layer adhered to the folder. The reinforcing film covers at least 50% of the outside surface of the file folder. This reinforcing film provides an excellent surface for receiving printed indicia on the matte finish outer surface. If the printed indicia is to be permanently bonded to the finished surface, a curable ink can be used. In addition, the matte finish allows user recordal of indicia using a ballpoint pen or lead pencil. This indicia is not prone to smudging, however, it can be manually removed if desired using a traditional rubber eraser. With this arrangement, the file folder can be reconditioned by removing of any indicia which is specific to the former use of the file folder. Thus the reinforcing film not only reinforces the tab but also provides a reconditionable writing surface on the file folder.

In a preferred aspect of the invention the outer layer of the reinforcing film is a cellulous base material.

In a further aspect of the invention, the reinforcing film is a breathable cellulose base material.

The present invention is also directed to a file folder comprising a body of paper stock and an exterior film substrate secured to the paper stock. The file folder has a front face and a rear face joined along a fold line. The front face is of a length to cooperate with the back face to form a labeling tab which extends beyond a marginal edge of the front face. The film substrate is secured to cover the exterior surface of the file folder and to cover both sides of the labeling tab. The film substrate comprises an underlying adhesive layer and an overlying cellulous based layer where the adhesive layer secures the film to the paper stock. The cellulous based layer has a treated surface finish which varies the depth of the overlying cellulous layer. This treated surface finish has superior properties with respect to receiving and retaining ink from ballpoint pens or receiving lead from pencils.

According to an aspect of the invention, the film substrate is at least partially translucent and the paper stock has been printed thereon with the print on the paper stock being visible through the film substrate.

In a further aspect of the invention, the paper stock has been printed with general information and/or category information to be used in assisting a user to enter specific summary information with respect to the contents of the file folder. The specific summary information is manually written or printed on the surface of the film substrate.

In yet a further aspect of the invention, the manually written or printed indicia on the surface of the film substrate are removable using a suitable eraser.

According to yet a further aspect of the invention, it has been found that the surface treated cellulous based layer provides an excellent receptor surface which provides strong adhesion with pressure sensitive labels such that the labels remain adhered to this layer during normal use of the file folder while allowing these labels to be removed if the file is to be reconditioned for a new application.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
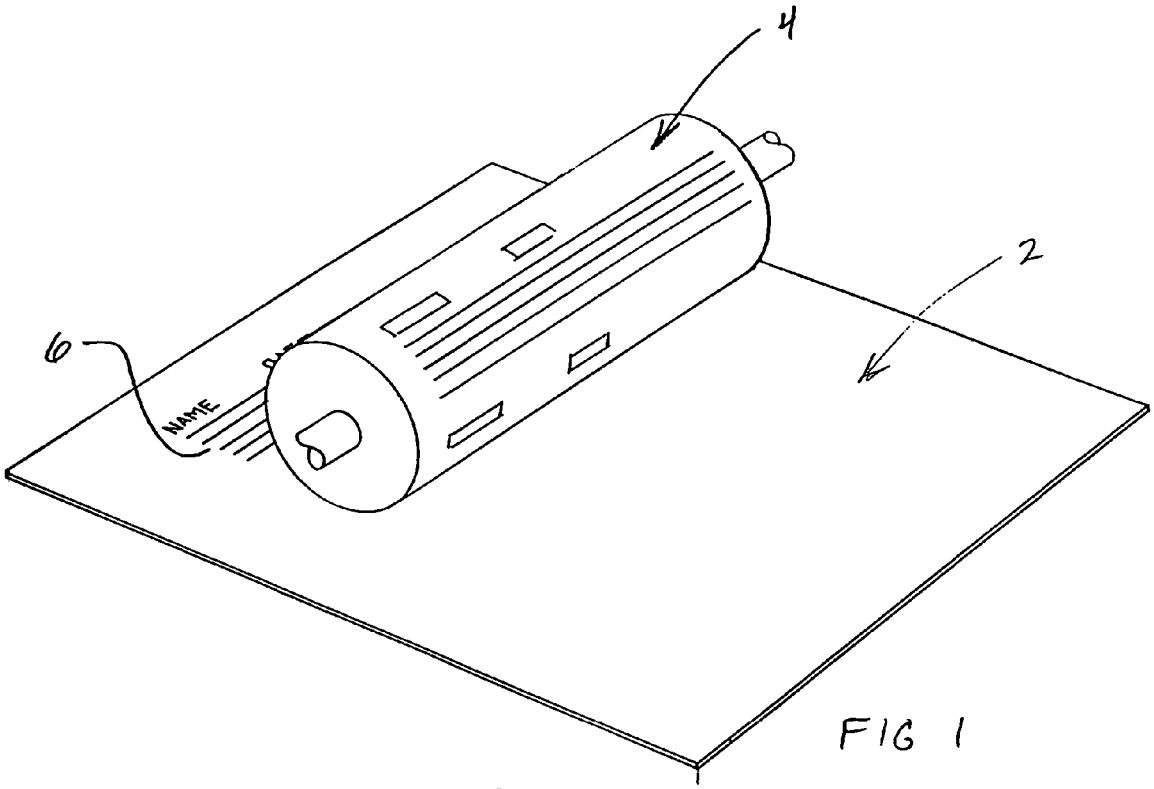
FIG. 1 is a perspective view showing printed indicia being applied to a paper substrate.

The paper stock 2 shown in FIG. 1 passes beneath a printing roller 4 which prints the indicia 6 on the surface of the paper stock. Typically this printed indicia 6 is applied only to the outside surface of the front face of a file folder, however, it can be applied to both the front and back surfaces. In some applications, it is desirable to also print the inside surface of a file folder with such information, therefore, the paper stock 2 can be printed at least on the outer surface to define certain general category type information that is desirable for a particular purchaser or industry. The paper stock is a cellulous material and reacts to different levels of humidity. In the past, changes in humidity have lead to label adhesion problems. Previously used polyethylene films provide reinforcement and better label securement. The ability to print indicia or manually write on this film is poor. This type of film has a smooth surface to enhance securement but manually written indicia tends to smudge.

Figure 2:
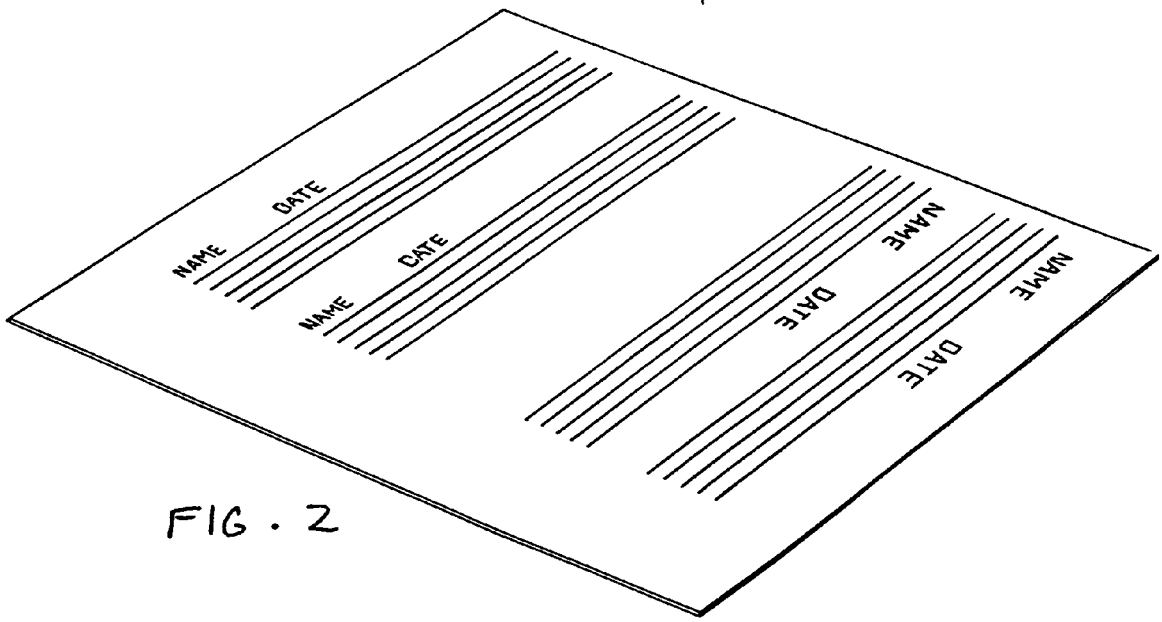
FIG. 2 is a perspective view similar to FIG. 1 with the various printed indicia applied to the substrate.

FIG. 2 shows a file folder blank which has been printed on the exterior surface with industry specific information. This file folder has particular application for government, medical and insurance industries where writing on the surface of the file folder is advantageous. The increased desirability in combination with the ability to custom print on or under the film makes the file folder suitable for financial, manufacturing, education or resource applications.

Figure 3:
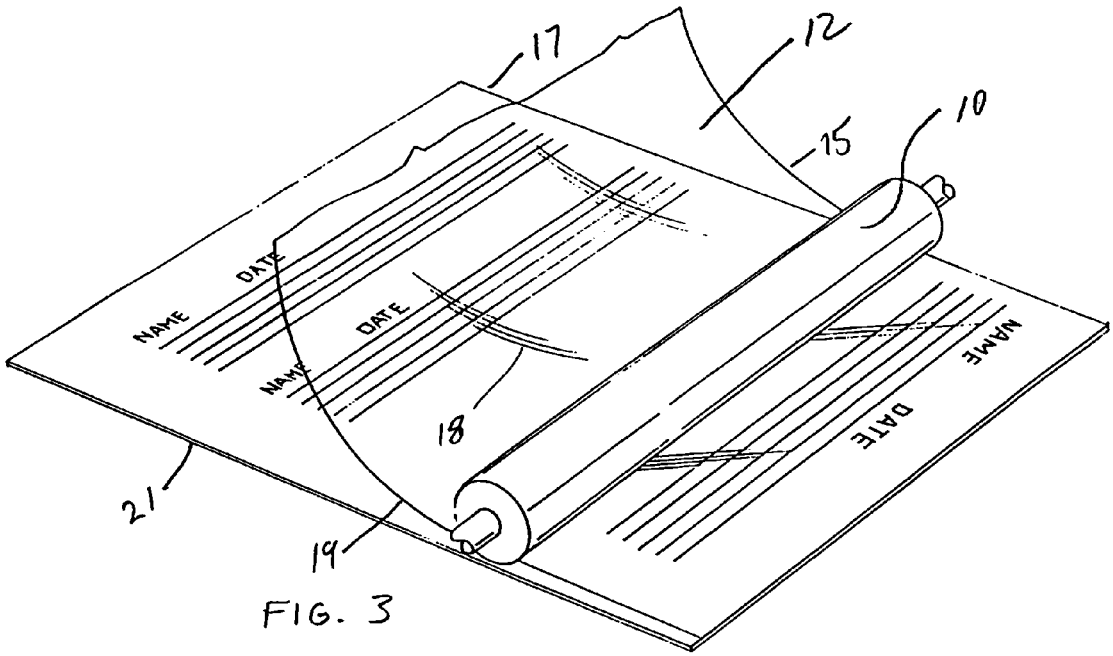
FIG. 3 is a perspective view showing the application of a reinforcing composite film substrate to the paper stock.

FIG. 3 shows the application of a reinforcing film substrate 12 applied to the paper stock 2 over the printed indicia 6 using the application roller 10. The film substrate 12 is preferably a transparent cellulous based material such that the printed indicia 6 are visible through the film. The film has a treated surface, preferably a matte finish 18 which provides an excellent surface for temporarily receiving user recorded information on the surface of a file folder. As shown in FIG. 3, the application of the reinforcing film substrate 12 is simplified by having the edge 15 of the film aligned with the edge 17 of the paper stock 2. The opposite edge 19 of the reinforcing film falls slightly short of the opposite edge 21 of the paper stock. With this arrangement, the reinforcing film substrate 12 is aligned with the edge 17 and is within the area of the paper stock.

The reinforcing film can also be a polyethylene layer with a matte or textured surface having an appropriate adhesive for securement to the paper substrate. For example, a heat activated polypropylene layer or a U.V. curable adhesive function satisfactorily.

Figure 4:
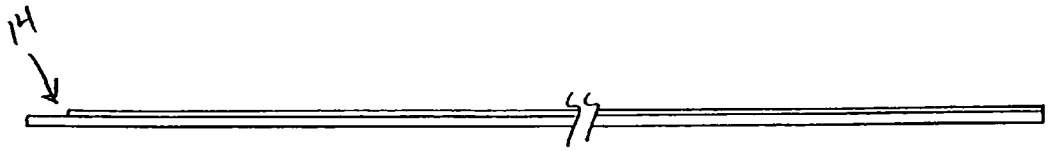
FIG. 4 is an end view showing the reinforcing composite film applied and secured to the paper stock.

This arrangement simplifies securing of the reinforcing film substrate 12, as alignment of the edges 15 and 17 is not critical. With this arrangement, the covered paper stock has a small border edge 14 as shown in FIG. 4 which is not covered by the reinforcing film substrate 12. This edge of the paper stock is folded over upon itself and as such, the border edge 14 will be protected within the file folder.

Figure 5:
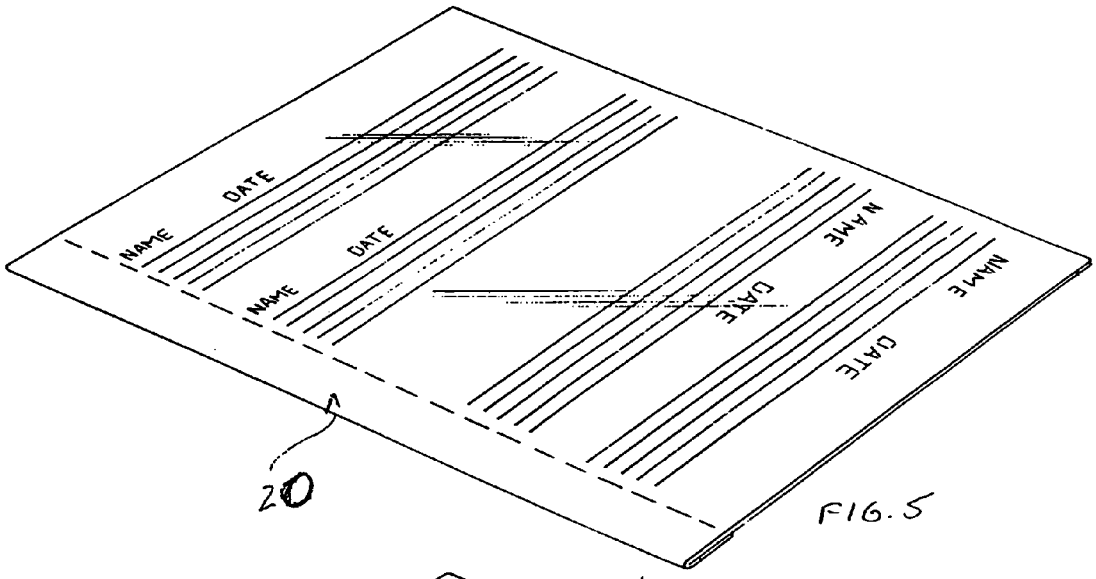
FIG. 5 is a perspective view of the paper stock with the film applied thereto and one edge of the paper stock folded and secured to itself.

FIG. 5 shows the printed paper stock 2 with the film substrate 12 secured thereto and the paper stock folded upon itself to produce the reinforced edge 20. The film substrate has an outer breathable layer and a lower adhesive layer. The adhesive layer is thermally activated by heat being applied to the breathable layer using the roller 10 which raises the temperature of the films to activate the underlying adhesive layer without damaging the upper layer. In this way, cellulous based reinforcing film is secured to the paper stock. It is also possible to use a UV curable adhesive or other appropriate adhesives. It is preferable that the adhesive be environmentally friendly and recyclable or easily separated during recycling of the file folder.

Figure 6:
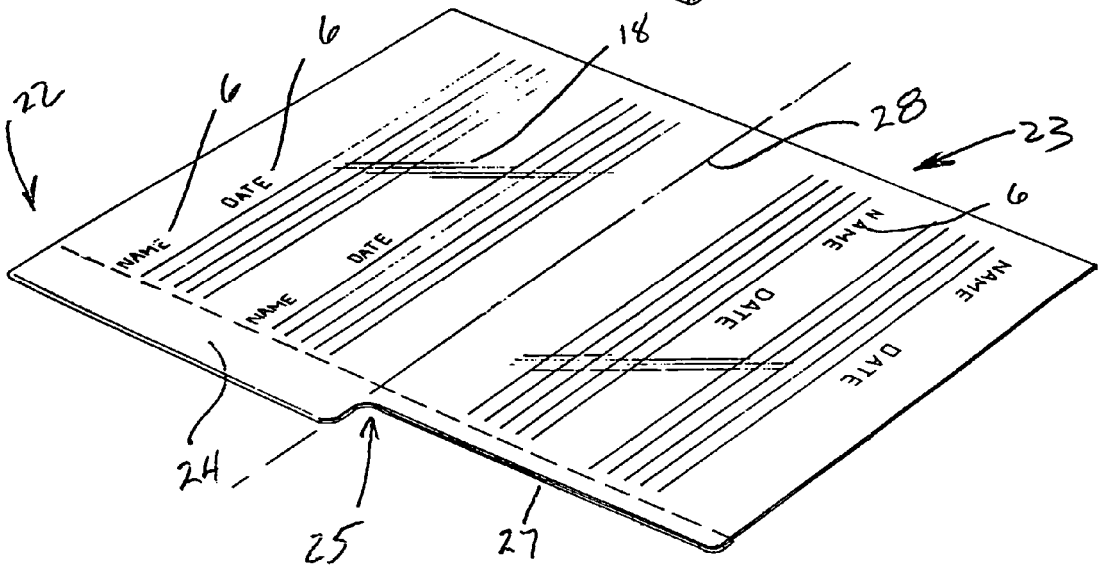
FIG. 6 shows a finished file folder.

FIG. 6 is similar to FIG. 5, however, the combined paper stock and film has been die cut to form a file folder. This file folder 23 has a reinforced edge 22, a labeling tab 24 and a fold line 28. In this case, the file folder has the reinforcing film substrate secured to the exterior surfaces of the file folder and wrapped about the labeling tab 24. This arrangement reinforces the labeling tab 24, reinforces the junction 25 between the labeling tab 24 and the reduced edge 27 and provides a file folder having excellent durability. The exterior surface of the file folder 23 has the various permanent indicia 6 visible through the film. The film has been provided with a recessed surface finish 18 which is typical of a matte finish. This improves the stacking of the file folders one on top of the other as the matte surface finish provides a higher co-efficient of friction such that the surfaces do not tend to slide one on the other. It also reduces problems associated with static electricity caused by relative movement of the file folders.

Figure 7:
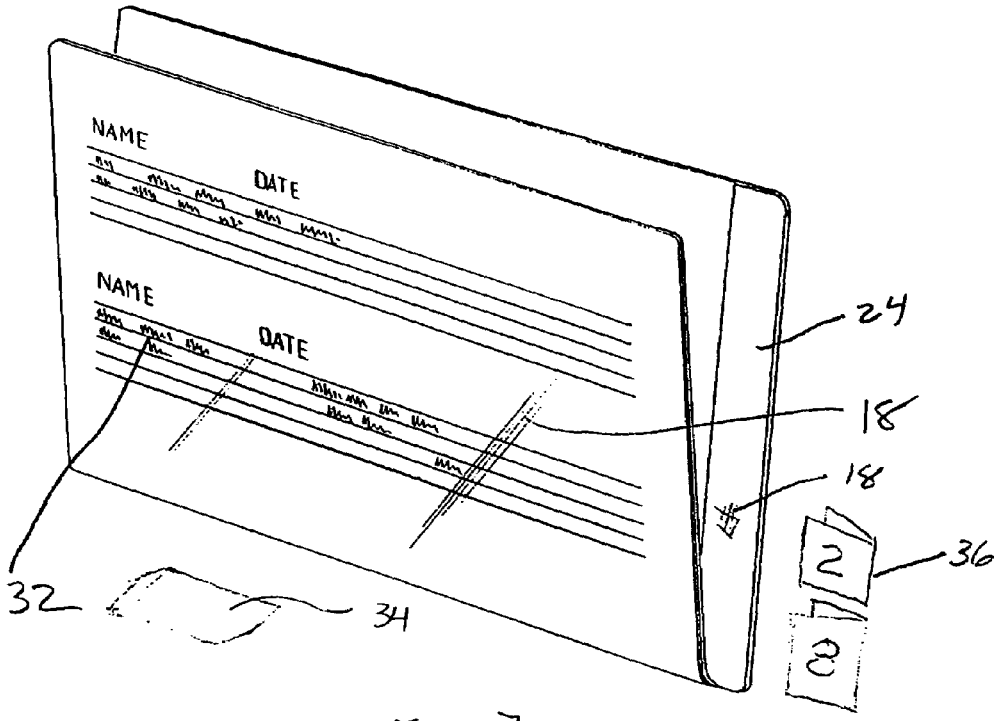
FIG. 7 is a perspective view of a finished file folder which includes specific information which has been written on the exterior of the file folder.

Further benefits of this surface 18 are shown in FIG. 7. The matte finish allows written indicia 32 to be retained on the exterior of the reinforcing film 12. These indicia if written with a pencil, ballpoint pen or Sharpie™ permanent marker demonstrate excellent durability during normal use of a file folder. The matte finish 18 provides recesses in the surface finish which serves to retain the ink or lead rendering these indicia less prone to smudging or accidental removal during normal use of the file. This information can be conveniently removed using a typical gum eraser 34. The matte finish 18 is also present on the labeling tab 24. Other writing tools can also be tested and used if appropriate. Pressure sensitive adhesive labels generally shown as 36 can be secured by the user or by the manufacturer according to the specific requirements of a user. The matte finish 18 provides strong adhesion of the pressure adhesive labels to the file folder. This is particularly desirable as these labels must continue to adhere to the file folder during the normal use and life of the file folder. Furthermore, it has been found that these pressure sensitive labels 36 can be removed by the user by peeling of the labels from the matte finish 18. It is believed the recessed surface of the reinforcing film provides excellent adhesion while still allowing manual removal of the labels if desired. The film also acts as an excellent receptor surface for labels having a cold liquid glue adhesive. Strong adhesion is achieved while still allowing manual removal of the labels. Other adhesives may also be suitable.

The use of a cellulose based film and appropriate adhesive allows for moisture exchange through the film similar to the paper stock. This provides advantages with respect to adhesion and retention of labels. Furthermore, the cellulous based film folds or creases in a manner similar to paper stock. The tendency of the film to return from a folded to a flat condition is reduced.

With the file folders generally shown in FIG. 7, the file folder can be reconditioned or reused for a subsequent application. It has been found that some industries, such as the medical or insurance industries, reuse file folders by removing the prior contents of the file folders. Under these circumstances, it is desirable to remove all existing labels such as labels 36 applied to the labeling tab and to remove any printed indicia 32 from the surface of the reinforcing film. The file folder as previously described allows this to occur easily and allows new labels to be applied to the labeling tab 24. This avoids labeling over previous labels which can cause difficulties as the adhesive properties will have changed. Typically, labels 36 will have a different surface finish than the surface finish 18. Removal of the labels avoids any issues with respect to poor adhesion due to changing characteristics of the original adhesive labels.

As can be appreciated, the reinforcing film can be used for top tab folders and side tab folders. Some industries use a file folder having both top and side tabs and the film is applied about both tabs. Film applied to both inside and outside surfaces of the file folder are suitable for certain high demand or wear applications. With the reinforcing film applied to both interior and exterior surfaces, the file folders are easily cleaned. These file folders have particular application for demanding environments such as project management field files. For example, the oil industry requires a durable file to withstand use by several users in a relatively "dirty" environment. Oil, grease and dirt are more easily removed from the exterior of the film. Laminating on both the inside and outside of the file folder increases durability and provides improved properties with respect to demanding applications.

The reinforcing film substrate 12 is preferable translucent to allow the indicia 6 to be visible through the substrate. This type of arrangement is particularly useful for large volume users where it is practical to have custom manufacture of the file folders. For many applications it would be desirable to have such a customized file folder for users where the volume is considerably less. Under these circumstances, the indicia 6 are not printed on the paper substrate 2. The file folders will be produced without the printed indicia 6 and thus a blank reinforced file folder will result. This blank reinforced file folder can be produced with the same economies of scale as a custom file folder in that large runs can be used. To provide the specific customization, the finished file folder is processed through a thermal printer or other suitable printer to apply similar indicia 6 directly on the surface of the reinforcing substrate. A curable permanent ink, such as a curable UV ink, can be used and as such, the finished reinforced file folders can be customized with the new indicia permanently secured to the reinforcing film substrate. This procedure can also be used for large volume applications.

With this arrangement, the file folders will be produced in large runs and maintained in inventory. Once a customized order has been received, a printing arrangement can be programmed to provide the desired indicia on the exterior face of the reinforced file folders. Thus, the printing step can be postponed until the customized order is received. In this way, the advantages of having large runs for manufacture of the file folder are achieved while allowing the customization of the file folder to be completed as a secondary step at a later point in time.

With both of the above arrangements, the file folder is suitable for repeated use or has extended life and durability.

Figure 8:
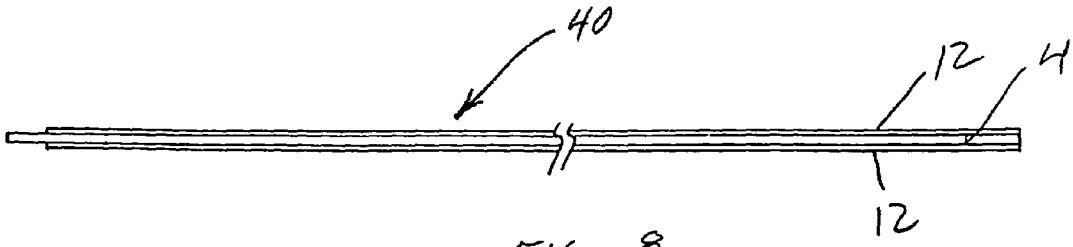
FIG. 8 is a partial sectional view through a paper substrate which has had reinforcing film applied by their side thereon.

The sectional view of FIG. 8 shows a paper substrate 4 which has a reinforcing film 12 applied to both the inside and the outside of the paper substrate 4. With this arrangement, the reinforcing films 12 are applied to both surfaces such that the inside and outside of the file folder is reinforced. It has been found that the paper substrate 4 can be made of a desirable paper stock and reinforced with the films 12. A paper stock 14 reinforced with the films 12 provides excellent durability and a life similar to a much heavier paper stock file folder. For example, a file folder made of paper stock 16 has excellent durability, however, the cost of the paper stock is relatively high. Similar life can be provided merely using a thinner paper stock such as paper stock 14 and applying the reinforced film to at least one surface or on both surfaces of the paper stock. This requires the additional cost of the reinforcing film, however, such a file folder has similar properties with respect to durability and expected life, while providing other desirable characteristics with respect to convenient removal of client specific information and can be produced at a similar or lower cost. The breathable cellulose based film allows application of the film to opposite sides of the substrate. The film provides extended folder life expectancy or similar life expectancy but using a lighter paper stock. Most file folders have a paper stock thickness of 10 to 16 thousandths of an inch.

A particularly desirable cellulose based film is sold under the trade-mark CLARIFOIL. This film is made of cellulose acetate and is available in different thicknesses. This film in combination with the paper substrate provides a file folder having good durability as well as the desirable features previously desired. This film is recyclable in a manner similar to paper stock. The matte upper surface finish is preferred to allow manual writing thereon and good adhesion with printable inks.

The cellulose based film is easily coloured to consistent standards. The manufacture of the folder can easily and quickly change over from one colour file folder to a different coloured file folder by changing the colour of the reinforcing film. The paper stock remains unchanged and can be bought in large quantities. With coloured reinforcing film, printing occurs on top of the film. This colour coding of file folders produces folders which are less prone to colour fade and have increased colour durability.

The cellulose based film reinforced file folder can advantageously be used with composite layered labels where the upper layer of the labels is a cellulous based film. With this combination, recycling of the file folder is simplified as all components are of a cellulose based material or of a material easily recycled during recycling of a paper substrate material.

The reinforced file folder having a cellulous based film has been described with respect to covering a majority of the front and back panels with the cellulous based film. It is also beneficial to use this cellulose based film having a matte finish on a labeling tab as superior labeling surface. Such a product provides the required durability and label retention properties with rendering the file folder more suitable for high quality recycling.

Although various preferred embodiments of the present invention have been described herein in detail, it will be appreciated by those skilled in the art, that variations may be made thereto without departing from the spirit of the invention or the scope of the appended claims.

The invention claimed is:

1. A composite file folder comprising a front panel, a back panel and a labeling tab along one edge of said back panel with said back panel and front panel being integral along one edge with a fold axis between said panels, said folder having a paper substrate support layer with a reinforcing film adhered to exterior surfaces of said front and back panels across said fold axis and applied to each side of labeling tab, said reinforcing film being a multi-layer breathable film having a matte finish outer surface consisting of a cellulose acetate film with an underlying water based adhesive layer adhered to said paper substrate support layer, said reinforcing film covering at least 50% of an outside surface of said file folder and allowing moisture exchange from said paper substrate support layer through said reinforcing film.

2. A composite file folder as claimed in claim 1 wherein said reinforcing film has printed indicia in permanent ink on the matte finish outer surface.

3. A composite file folder as claimed in claim 2 wherein said printed indicia is strongly bonded or adhered to said matte finish outer surface wherein said printed indicia is printed using a UV curable permanent ink.

4. A composite file folder as claimed in claim 1 wherein said reinforcing film is clear and said paper substrate support layer includes printing on the surface thereof visible through said reinforcing film.

5. A composite file folder as claimed in claim 1 wherein said reinforcing film covers at least 75% of the outside surface of said paper substrate support layer.

6. A composite file folder as claimed in claim 1 wherein said paper substrate support layer has a thickness in the range of 10 to 16 thousandths of an inch and said reinforcing film has a thickness of less than 0.6 mils.

7. A composite file folder as claimed in claim 1 wherein said reinforcing film is secured to generally cover both the inside and outside surfaces of said front panel and said back panel.

8. A recyclable file folder comprising a paper stock substrate folded to form a front panel, a back panel and a labeling tab along one edge of said back panel, said file folder further including a cellulose based reinforcing film adhered to both a front and rear side of said labeling tab and extending over at least a border region on an exterior surface of said back panel, said reinforcing film being a breathable layer allowing moisture exchange therethrough and wherein said cellulose based reinforcing film is adhered to said paper substrate by water based adhesive.

9. A recyclable file folder as claimed in claim 8 wherein said reinforcing film has a matte exterior finish.

10. A recyclable file folder as claimed in claim 9 including a series of discrete labels adhered to said labeling tab, each discrete label including an outer cellulose based film layer.

11. A recyclable file folder as claimed in claim 10 wherein each discrete label includes water based adhesive layer securing the label to the reinforcing film.

12. A recyclable file folder as claimed in claim 8 wherein said reinforcing film has an exterior textured surface providing improved adhesion with water based adhesives and improved adhesion with cooperating inks.

13. A recyclable file folder as claimed in claim 12 wherein said reinforcing film extends over and generally covers the exterior surfaces of said front and back panels and is colored to determine the color of said exterior surfaces.

14. A recyclable file folder as claimed in claim 13 wherein said reinforcing film includes printed indicia on the surface of the reinforcing film.

15. A recyclable file folder as claimed in claim 14 wherein reinforcing film provides an erasable surface for conventional ink and pencil markings.

16. A recyclable file folder as claimed in claim 8 wherein said reinforcing film covers exterior surfaces of said front and back panels of said file folder and is colored to determine the exterior color of said file folder.

17. A recyclable file folder as claimed in claim 16 wherein said reinforcing film has an exterior matte finish and provides a receptor surface for receiving adhesive labels thereon and a manual recording surface for receiving ink or pencil markings while allowing manual erasing thereof.

* * * * *